US011350698B2

(12) United States Patent
Fogarty et al.

(10) Patent No.: US 11,350,698 B2
(45) Date of Patent: Jun. 7, 2022

(54) INTERCHANGEABLE SHOE

(71) Applicants: Cindy Fogarty, Millmerran (AU); Nate Finlay, South Salt Lake, UT (US); Jennie Drew Platt, Salt Lake City, UT (US)

(72) Inventors: Cindy Fogarty, Millmerran (AU); Nate Finlay, South Salt Lake, UT (US); Jennie Drew Platt, Salt Lake City, UT (US)

( * ) Notice: Subject to any disclaimer, the term of this patent is extended or adjusted under 35 U.S.C. 154(b) by 197 days.

(21) Appl. No.: 16/807,700

(22) Filed: Mar. 3, 2020

(65) Prior Publication Data

US 2021/0274883 A1 Sep. 9, 2021

(51) Int. Cl.

| | |
|---|---|
| ***A43B 3/24*** | (2006.01) |
| ***A43B 13/36*** | (2006.01) |
| ***A43B 23/22*** | (2006.01) |

(52) U.S. Cl.

CPC ..... *A43B 13/36* (2013.01); *A43B 3/24* (2013.01); *A43B 3/244* (2013.01); *A43B 23/222* (2013.01)

(58) Field of Classification Search

CPC ..... A43B 3/24; A43B 3/242; A43B 3/244; A43B 3/246; A43B 13/36

USPC ..... 36/15, 100, 101

See application file for complete search history.

(56) References Cited

U.S. PATENT DOCUMENTS

| | | | | | |
|---|---|---|---|---|---|
| 2,368,314 | A * | 1/1945 | Marx | A43B 3/103 | 36/11.5 |
| 2,519,108 | A * | 8/1950 | Bryant | A43B 3/24 | 36/12 |
| 2,552,943 | A * | 5/1951 | Danielius | A43B 3/24 | 36/101 |
| 2,761,224 | A * | 9/1956 | Gardiner | A43B 3/24 | 36/11.5 |
| 3,204,346 | A * | 9/1965 | Lockard | A43B 3/24 | 36/101 |
| 4,326,313 | A * | 4/1982 | Bensley | A43D 25/06 | 12/142 D |
| 4,343,057 | A * | 8/1982 | Bensley | A43D 25/06 | 12/142 D |
| 4,420,894 | A * | 12/1983 | Glassman | A43B 13/28 | 36/107 |
| 4,586,209 | A * | 5/1986 | Bensley | A43D 25/06 | 12/142 D |
| 4,887,369 | A * | 12/1989 | Bailey | A43B 3/24 | 36/101 |
| 5,065,531 | A * | 11/1991 | Prestridge | A43C 1/00 | 36/100 |
| 5,317,822 | A * | 6/1994 | Johnson | A43B 13/36 | 36/101 |
| 5,337,491 | A * | 8/1994 | Mascotte | A43B 3/16 | 36/7.1 R |
| 5,983,528 | A * | 11/1999 | Hartung | A43B 3/24 | 36/101 |

(Continued)

*Primary Examiner* — Marie D Bays

(74) *Attorney, Agent, or Firm* — Superior IP, PLLC; Dustin Call

(57) ABSTRACT

An interchangeable shoe. The interchangeable shoe includes a base, where the base includes a footbed, and an upper. The interchangeable shoe also includes an attachment, where the attachment releasably attaches the upper to the base, The attachment includes a groove in the footbed and a rail attached to the upper, where the rail is configured to be inserted into or removed from the groove.

18 Claims, 7 Drawing Sheets

(56) References Cited

U.S. PATENT DOCUMENTS

| | | | | |
|---|---|---|---|---|
| 7,698,834 | B1 * | 4/2010 | Courville | A43B 3/24 36/15 |
| 2005/0235522 | A1 * | 10/2005 | Crowley, II | A43B 3/242 36/2 R |
| 2008/0098623 | A1 * | 5/2008 | Komitau | A43B 3/244 36/101 |
| 2009/0229145 | A1 * | 9/2009 | Ortner | A43B 3/24 36/100 |
| 2013/0269214 | A1 * | 10/2013 | Fogarty | A43B 13/14 36/101 |
| 2014/0033568 | A1 * | 2/2014 | Pearson | A43B 21/36 36/100 |
| 2016/0095379 | A1 | 4/2016 | Fogarty | |
| 2017/0224047 | A1 * | 8/2017 | Walker | A43B 3/242 |
| 2018/0325208 | A1 * | 11/2018 | Delaney | A43B 23/0295 |

* cited by examiner

INTERCHANGEABLE SHOE

CROSS-REFERENCE TO RELATED APPLICATIONS

Not applicable.

BACKGROUND OF THE INVENTION

People, mainly women, generally tend to prefer, purchase and wear fashionable attire. Fashion dictates that a woman's outfit coordinates with her other belongings such as handbag and shoes. Purchasing a large variety of shoes to complete a matching ensemble for each outfit in her wardrobe is extremely costly for most women. Furthermore, since shoe fashions rapidly change, there is an ever present need to update the shoe wardrobe to complement the clothing wardrobe. Prevailing economic conditions demand conservation and re-useable goods.

However, the purchase of numerous shoes is problematic for various reasons. In particular, it can get expensive for a shoe owner to purchase different shoes for different occasions, especially when the majority of the shoes are the same. For example, all flats have basically the same base, which means that the majority of materials are the same, but the portions which are different require an entirely new purchase. This is both expensive and wasteful.

Some interchangeable shoes use temporary attachment methods, such as snaps or hook and loop fasteners. These suffer from a number of drawbacks, including hurting the user's foot and a propensity for coming undone while the user is walking. A user is unlike to use shoes of this type for long.

Other shoes have portions that include a transparent plastic film which creates a "pouch" constructed to receive, retain and display interchangeable inserts. However, these plastic parts are often uncomfortable for the user and cause rubbing on the user's foot.

Accordingly, there is a need in the art for a shoe attachment that is readily and easily fitted, economical, aesthetic and color or fashion coordinated. Further, there is a need in the art for an interchangeable shoe that is comfortable for the user and remains secured until the user desires to make a change.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes an interchangeable shoe. The interchangeable shoe includes a base, where the base includes a footbed, and an upper. The interchangeable shoe also includes an attachment, where the attachment releasably attaches the upper to the base, The attachment includes a groove in the footbed and a rail attached to the upper, where the rail is configured to be inserted into or removed from the groove.

Another example embodiment includes an interchangeable shoe. The interchangeable shoe includes a base, where the base includes a footbed, and an upper. The interchangeable shoe also includes an attachment, where the attachment releasably attaches the upper to the base. The attachment includes a groove in the footbed. The groove includes chamfered edges and varying width in different sections of the groove. The groove also includes a detent on one end of the groove. The interchangeable shoe also includes a rail attached to the upper. The rail is configured to be inserted into or removed from the groove. The rail includes a body and a bar on the body, where the bar is sized and shaped to match the size and shape of the groove. The rail also includes one or more flex cuts in the bar, where the one or more flex cuts are configured to allow the bar to flex. The rail further includes a snap, where the snap is configured to mate with the detent in the groove. The rail additionally includes a cap over the snap, where the cap is configured to cover the detent and snap when mated. The rail moreover includes a webbing, where the webbing attaches the body to the upper.

Another example embodiment includes an interchangeable shoe. The interchangeable shoe includes a base, where the base includes a footbed, and an upper. The interchangeable shoe also includes an attachment, where the attachment releasably attaches the upper to the base. The attachment includes a groove in the footbed. The groove includes chamfered edges and varying width in different sections of the groove. The groove also includes a detent on one end of the groove. The groove further includes a sloped area adjacent the detent, where the height of the groove changes in the sloped area, and a curved on the end of the groove opposite the detent. The interchangeable shoe also includes a rail attached to the upper. The rail is configured to be inserted into or removed from the groove. The rail includes a body and a bar on the body, where the bar is sized and shaped to match the size and shape of the groove. The rail also includes one or more flex cuts in the bar, where the one or more flex cuts are configured to allow the bar to flex. The rail further includes a snap, where the snap is configured to mate with the detent in the groove. The rail additionally includes a cap over the snap, where the cap is configured to cover the detent and snap when mated. The rail moreover includes a webbing, where the webbing attaches the body to the upper.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
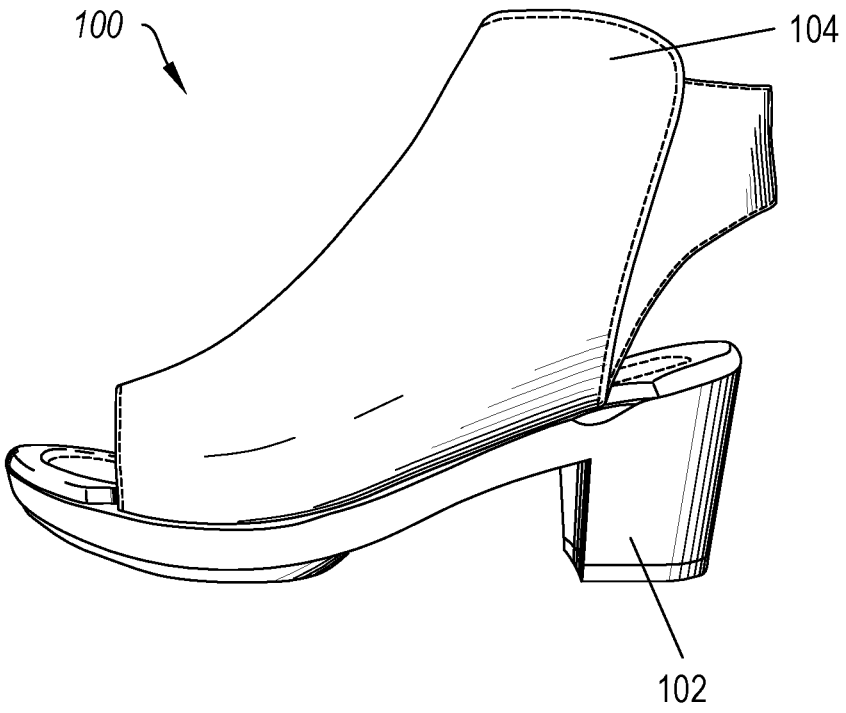
FIG. 1 illustrates an example of an interchangeable shoe.

FIG. 1 illustrates an example of an interchangeable shoe 100. The interchangeable shoe 100 is an item of footwear intended to protect and comfort the human foot. The interchangeable shoe 100 may also be used as an item of decoration and fashion. The interchangeable shoe 100 can vary from basic sandals (which may consist of only a thin sole and simple strap) to high fashion shoes made of expensive materials, use complex construction and sell for hundreds or even thousands of dollars a pair. The interchangeable shoe 100 allows a user to retain the base 102 and change the upper 104. That is, a normal shoe requires a user to select both a base and an upper simultaneously, since the upper is permanently attached to the base; in contrast, the interchangeable shoe 100 allows the user to select the base 102 and the upper 104 independently and then releasably secure the upper to the base.

FIG. 1 shows that the interchangeable shoe 100 includes a base 102. The base 102 is the portion of the shoe 100 which touches the ground and on which the user's foot rests. I.e., the base of the shoe is the portion that actually supports the foot of the user. Although a heeled base 102 is shown herein, any base can be used (e.g., flats, etc.).

FIG. 1 also shows that the interchangeable shoe includes an upper 104. The upper 104 is placed over the foot over the user. I.e., the upper 104 can provide some support (especially to the sides of the user's feet) but is also decorative. For example, the upper 104 can be a complete cover which entirely hides the feet of the user and/or portions of the user's ankle and leg or the upper 104 can include straps which only cover a portion of the user's foot. The upper is releasable relative to the base 102. That is, the upper 104 is only releasably attached to the base 102, as disclosed below.

The basic anatomy of the interchangeable shoe 100, as used herein, is defined as:

Base 102 (aka sole)—all shoes have a sole, which is the bottom of a shoe, in contact with the ground. The base 102 can be made from a variety of materials, although most modern shoes have a base 102 made from natural rubber, polyurethane, or polyvinyl chloride (PVC) compounds. The base 102 can be simple—a single material in a single layer—or it can be complex, with multiple structures or layers and materials. When various layers are used, the base 102 may consist of an insole, midsole, and an outsole.

Insole (aka footbed)—the insole is the interior bottom of a shoe, which sits directly beneath the user's foot. The purpose of the insole is to support the foot of the user. Insoles are usually made of cellulosic paper board or synthetic non woven insole board. Many shoes have removable and replaceable footbeds. Extra cushioning is often added for comfort (to control the shape, moisture, or smell of the shoe) or health reasons (to help deal with differences in the natural shape of the foot or positioning of the foot during standing or walking).

Outsole—the outsole is the layer in direct contact with the ground. Dress shoes often have leather or resin rubber outsoles; casual or work-oriented shoes have outsoles made of natural rubber or a synthetic material like polyurethane. The outsole may comprise a single piece, or may be an assembly of separate pieces, often of different materials. On some shoes, the heel of the sole has a rubber plate for durability and traction, while the front is leather for style. Specialized shoes will often have modifications on this design (e.g., athletic or so-called cleated shoes like soccer, rugby, baseball and golf shoes have spikes embedded in the outsole to improve traction).

Midsole—the midsole is the layer in between the outsole and the insole, typically there for shock absorption. Some types of shoes, like running shoes, have additional material for shock absorption, usually beneath the heel of the foot, where one puts the most pressure down. Some shoes may not have a midsole at all.

Heel—the heel is the bottom rear part of a shoe. Its function is to support the heel of the foot. They are often made of the same material as the sole of the shoe. This part can be high for fashion or to make the person look taller, or flat for a more practical and comfortable use. On some shoes the inner forward point of the heel is chiseled off, a feature known as a "gentleman's corner". This piece of design is intended to alleviate the problem of the points catching the bottom of trousers and was first observed in the 1930s. A heel is the projection at the back of a shoe which rests below the heel bone. The shoe heel is used to improve the balance of the shoe, increase the height of the wearer, alter posture or other decorative purposes. Sometimes raised, the high heel is common to a form of shoe often worn by women, but sometimes by men too.

Upper 104—the upper helps hold the shoe onto the foot. In the simplest cases, such as sandals or flip-flops, this may be nothing more than a few straps for holding the sole in place. Closed footwear, such as boots, trainers and most men's shoes, will have a more complex upper. This part is often decorated or is made in a certain style to look attractive. The upper is connected to the sole by a strip of leather, rubber, or plastic that is stitched between it and the sole, known as a welt. Most uppers have a mechanism, such as laces, straps with buckles, zippers, elastic, Velcro straps, buttons, or snaps, for tightening the upper on the foot. Uppers with laces usually have a tongue that helps seal the laced opening and protect the foot from abrasion by the laces. Uppers with laces also have eyelets or hooks to make it easier to tighten and loosen the laces and to prevent the lace from tearing through the upper material. An aglet is the protective wrapping on the end of the lace.

Vamp—the vamp is the front part of the shoe, starting behind the toe, extending around the eyelets and tongue and towards back part of the shoe.

Medial—the medial is the part of the shoe closest to a person's center of symmetry, and the lateral is on the opposite side, away from their center of symmetry. This can be in reference to either the outsole or the vamp. Most shoes have shoelaces on the upper, connecting the medial and lateral parts after one puts their shoes on and aiding in keeping their shoes on their feet.

Toe box—the toe box is the part that covers and protects the toes. People with toe deformities, or individuals who experience toe swelling (such as long-distance runners) usually require a larger toe box.

Figure 2:
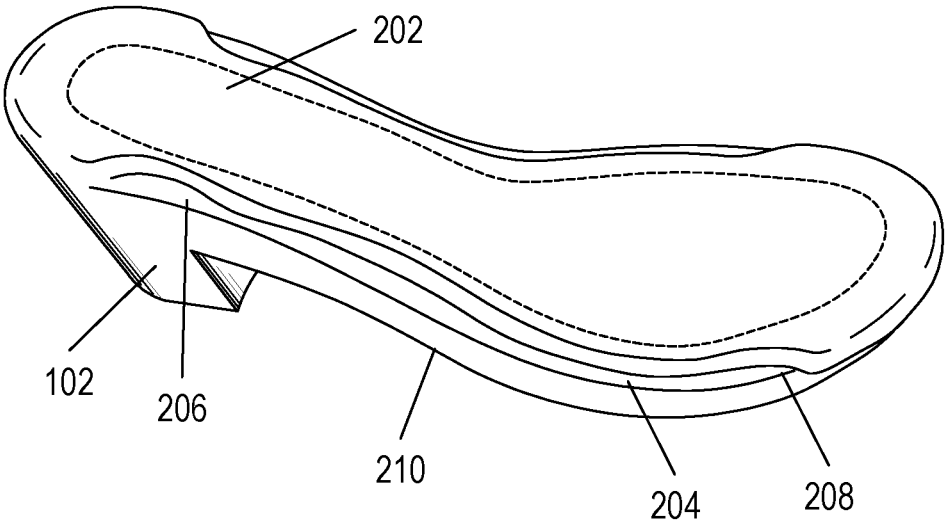
FIG. 2 illustrates an example of a base.

FIG. 2 illustrates an example of a base 102. The base 102 can include numerous designs which go under the user's foot. That is, the base 102 is the support of the interchangeable shoe and supports the user's foot. The base 102 can include an insole, midsole and/or outsole and is configured to receive an upper 104. As used in the specification and the claims, the phrase "configured to" denotes an actual state of configuration that fundamentally ties recited elements to the physical characteristics of the recited structure. That is, the phrase "configured to" denotes that the element is structurally capable of performing the cited element but need not necessarily be doing so at any given time. Thus, the phrase "configured to" reaches well beyond merely describing functional language or intended use since the phrase actively recites an actual state of configuration.

FIG. 2 shows that the base 102 can include a footbed 202. The footbed 202 provides a surface on which the user rests his/her feet. The footbed 202 can be of different shapes to accommodate the different shapes of feet. Likewise, the footbed 202 can include different features based on the needs of the user. For example, the footbed 202 can include different arches to accommodate different users or can include different materials to increase user comfort, etc.

FIG. 2 also shows that the base 102 can include a groove 204. The groove 204 receives the shoe upper, as disclosed below. The groove 204 can include many different shapes; however, a "P" or "L" shaped cross-section provides a number of benefits over other shapes. For example, a "P" or "L" shaped cross-section makes insertion of the upper easier and allows the attachment of the upper to proceed more smoothly (i.e., the upper slides through the groove easier). In addition, a "P" or "L" shaped cross-section provides a very secure attachment. Further, a "P" or "L" shaped cross-section allows the attachment to be flexible during insertion or removal. One of skill in the art will appreciate that other types of rails, such as a magnetic strip are also contemplated herein.

Further, additional features of the groove 204 reduce or eliminate problems that arise during use. For example, the edges of the groove 204 include chamfers, bevels or angles to reduce friction when inserting, sliding, or removing the upper. It was observed that with parallel sides to the groove 202 binding would occur during the insertion or removal of the upper. Addition of the chamfers, bevels or angles served to significantly reduce binding.

Likewise, the width of the groove 204 varies based on characteristics of the footbed 202. For example, the groove is not a "parallel" groove 204 (meaning the groove 204 is not a consistent width along the length of the groove 204). It was found that a parallel groove 204 causes binding and doesn't allow the upper to flex when needed (e.g., when the edge of the footbed 202 isn't straight). For example, the groove 204 can be wider in the middle and thinner on the entry point and at the base of the groove 204, which provides at least three benefits: 1) when the groove 204 has a bend or curve, a wider groove 204 prevents flex and allows the upper to take the proper shape; 2) prevents binding in any non-straight portions of the groove 204; and 3) it also creates a stronger attachment area at the start and stop points of the groove 204 reducing the potential for the upper to pull free from the groove 204 unexpectedly.

FIG. 2 additionally shows that the groove 204 can include a detent 206. A detent 206 includes a device (such as a catch) for positioning and holding one mechanical part in relation to another in a manner such that the device can be released by force applied to one of the parts. Thus, the detent 206 is a portion of the groove 204 that will receive and hold a portion of the upper until released by the user. For example, the portion of the upper that goes in the groove can include section which snaps into the detent 206. Further, the detent 206 can be wider than the groove 204, which allows a portion of the upper to be inserted within the groove 204 and then moved along the groove 204 prior to being secured. I.e., the size of the detent 206 can make it easier to insert a portion of the upper within the groove.

The detent 206 can include other fastening mechanisms. For example, the detent 206 can include a magnetic locking feature. I.e., rather than snapping into the groove 204, the upper can have a magnetic or ferromagnetic element that is placed in the detent 206 to retain the upper within the groove 204.

FIG. 2 moreover shows that the groove 204 can include a curved end 208. The curved end 208 can be critical for at least two reasons. First the curved end 208 makes the combination of the upper and the base 102 look more like a "normal" (i.e., not interchangeable) shoe. Second, it was found that with a straight end that the end of the groove 204 could create a sharp point that irritated the foot of the user. The curved end 208 removes this problem and increases the comfort of the user.

FIG. 2 further shows that the base 102 can include an outsole 210. The outsole 210 is the portion of the shoe that rests on the ground. The outsole 210 can include traction or other features to prevent the user from slipping. Likewise, the outsole 210 can include decorative or fashion elements, as desired by the user. The outsole 210 can include any desired material, such as rubber, leather, etc.

The footbed 202 is attached to the outsole 210 (either directly or via a midsole), creating a single piece from the user's perspective. For example, one implementation can include a footbed 202—made of a softer material, such as foam or rubber with leather stitched around the softer material—to a lower midsole. The stitch line assures that the top layer and foam are completely held together. This layer is then glued to the acrylonitrile butadiene styrene ("ABS") midsole. The midsole/footbed 202 combination is then attached to the outsole 210 creating a complete base 102.

Figure 3:
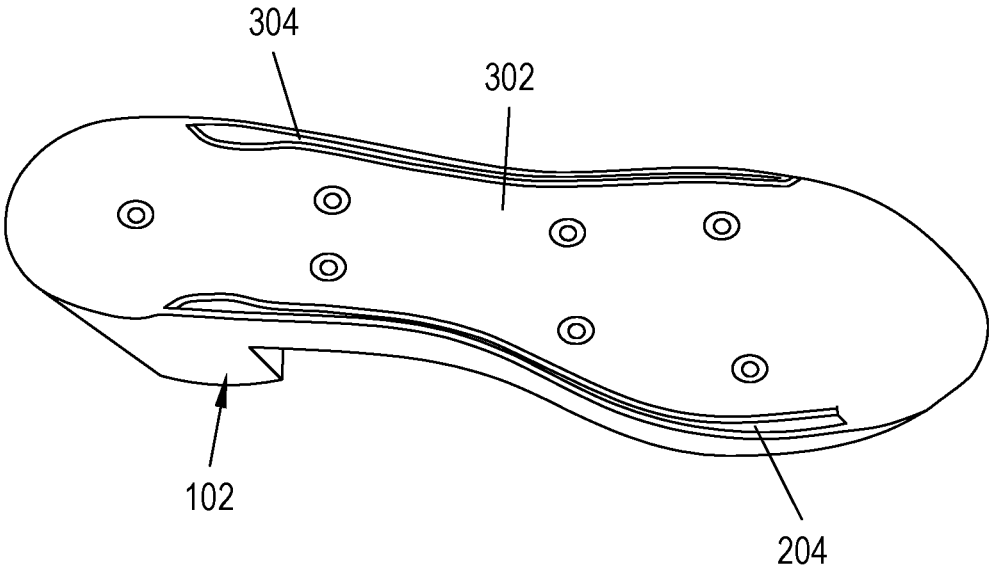
FIG. 3 illustrates an example of the base without the footbed.

FIG. 3 illustrates an example of the base 102 without the footbed. I.e., FIG. 3 illustrates the interior of the base 102 which allows for attachment of the footbed and allows the upper to be attached. One of skill in the art will appreciate that this is just one example embodiment, and many other embodiments are contemplated herein.

FIG. 3 shows that the base 102 includes a midsole 302. The midsole 302 resides in the interior of the base 302 and is securely attached to the footbed. I.e., the midsole 302 acts to attach the footbed to the outsole. Likewise, the midsole 302 provides structural support to the outsole, ensuring that the base 102 is sufficiently strong to hold the weight of the user.

FIG. 3 shows that the midsole 302 can include a portion of the groove 204. I.e., the midsole 302 forms the "bottom" and "sides" of the groove 204 (with the footbed potentially forming the "top" of the groove 204). That is, the midsole 302 has a "trench" that is a portion of the groove 204. Thus, the midsole 204 experiences little or no force that seeks to pull the upper out of the groove 204, as those forces are experienced almost exclusively by the footbed; however, those forces are transferred to the footbed through the attachment to the midsole 302. I.e., forces on the footbed tend to try to separate the footbed from the midsole 302.

One of skill in the art will appreciate that the height of the groove 204 is based on the "minimum" height needed to allow attachment of the upper to move easily but continue to provide sufficient strength that the upper will not break or pop out when walking or extreme force is applied.

FIG. 3 additionally shows that the groove 204 can include a sloped area 304. The sloped area is curved up to allow the upper to be easily inserted or removed. That is, the sloped area provides a "ramp" for the upper to be inserted or removed. One of skill in the art will appreciate that the top of the groove 204 above the sloped area 304 is open to allow for the upper to be removed and inserted. That is, the portion of the groove with the sloped area 304 does not provide structural support when there is force on the upper, so the length and size of the sloped area 304 must be balanced to allow insertion without overly weakening the attachment of the upper to the base 102.

FIG. 3 further shows that the midsole 302 can include one or more attachment points 308. The attachment points 308 allow the footbed to be attached to the midsole 302. For example, the footbed can be screwed or glued to the attachment points 308. The attachment points 308 need to be sufficient in number to ensure that the footbed does not separate from the midsole 302 because of regular use.

Figure 4:
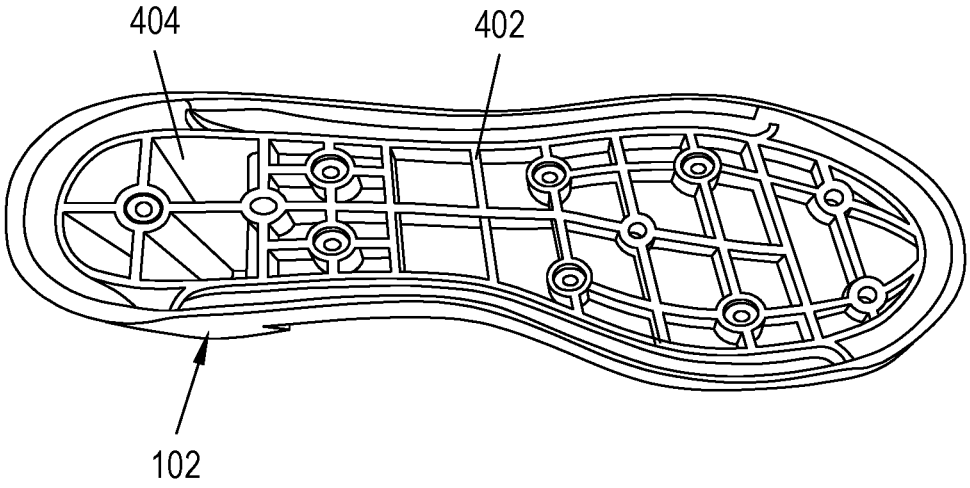
FIG. 4 illustrates an example of a base without the midsole.

FIG. 4 illustrates an example of a base 102 without the midsole. I.e., FIG. 4 illustrates the interior of the base 102 which allows for attachment of the midsole. One of skill in the art will appreciate that this is just one example embodiment, and many other embodiments are contemplated herein.

FIG. 4 shows that the base 102 can include a series of ribs 402. The ribs 402 allow for the attachment of the midsole and provide structural support to the base 102. That is, the midsole is attached to the ribs 402 either directly, such as via screws or adhesive, or indirectly using some other attachment method. The ribs 402 control the flex of the base 102 to prevent removal of the upper from the groove 204. That is, if the groove 204 is able to flex in such a way that the top of the groove 204 is too wide, the upper will pull out so the flex needs to be controlled.

One of skill in the art will appreciate that the ribs 402 add strength to the base 102 and reduce weight. However, the ribs 402 also create empty cavities 404 which can create noise while walking. Therefore, the cavities 404 can be filled with a material, such as foam or polyester to reduce noise without appreciably increasing weight or reducing strength.

Figure 5:
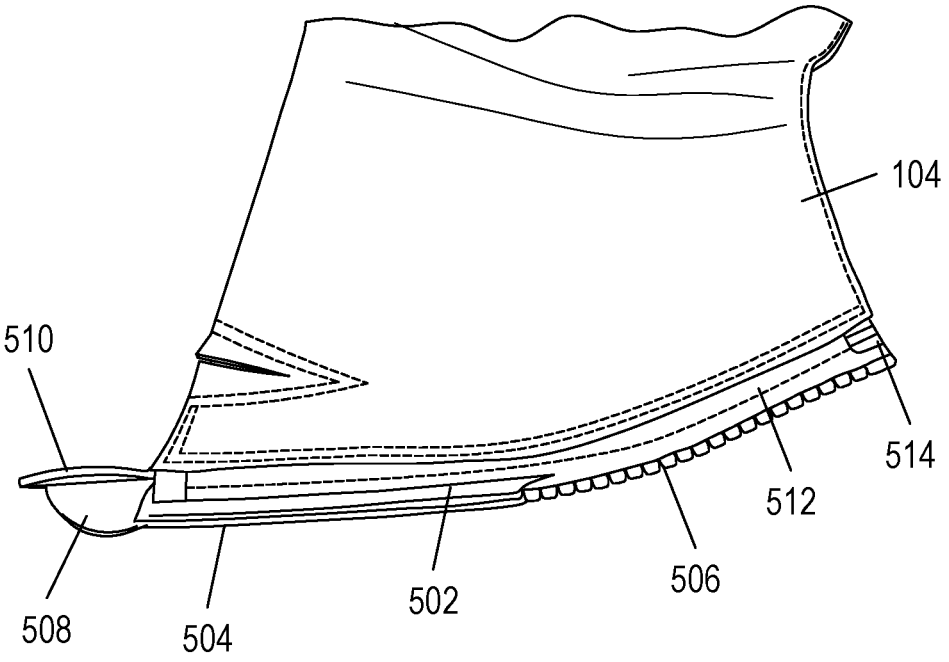
FIG. 5 illustrates an example of an upper.

FIG. 5 illustrates an example of an upper 104. The upper 104 attaches to the base and forms a part of the look of the shoe. Any upper 104 style is contemplated herein. For example, the types of uppers 104 that may be used can vary from boot style, to shoe style, to a flip flop style and can surround only a portion of the user's foot or can surround the entirety of the user's foot and even a portion of the user's leg.

FIG. 5 shows that the upper 104 can include a rail 502. The rail 502 serves as an attachment point to the base. I.e., the rail 502 is the portion of the upper 104 which is inserted into the groove and then secures the upper to the base. The rail 502 is secured to the rest of the upper 502 and is along the edges of the upper. The rail 502 to can be colored or otherwise matched to the rest of the upper; however, much of the rail 502 is hidden during attachment to the base.

FIG. 5 also shows that the rail 502 can include a bar 504. The bar 504 is "P" or "L" shaped to match the groove. A bar 504 which is "I" or "T" shaped suffers from a number of problems. In, particular, the "I shape can't secure the upper and the amount of friction is higher in a "T" shaped rail. I.e., a "P" or "L" shaped bar 504 has less surface that is in direct contact with the groove and therefore reduces the amount of friction and is more flexible to accommodate curves in the groove. The bar 504 can include any suitable material, but materials that have a low coefficient of friction are preferred. For example, the bar 504 can include thermoplastic polyurethane ("TPU"), polypropylene ("PP") plastic or any other suitable material. Likewise, the finish of the material can be used to lower the coefficient of friction. The smoother the material, the lower the coefficient of friction. The bar 504 can be injection molded at a lower temperature to allow bonding to other portions of the rail 502, which allows the rail 502 to inserted easier by the user, as the attached portions can be thinner and or slide easier.

FIG. 5 further shows that the rail 502 can include one or more flex cuts 506. The flex cuts 506 allow the bar 504 to flex in directions which are perpendicular to the main axis of the bar 504. This is critical to allow the bar 504 to bend with the groove without getting stuck. That is, as the groove has bends either side-to-side or up-and-down (for example at the sloped area 304 of FIG. 3), the flex cuts 506 allows the bar 504 to match the shape and slope of the groove.

FIG. 5 moreover shows that the rail 502 can include a snap 508. The snap 508 can be secured within the detent of the base. This prevents movement of the rail 502 relative to the base. This is critical to prevent rubbing of the user's foot, which can cause irritation to the user. Likewise, it ensures that the rail 502 is not removed from the groove earlier than desired by the user and that the upper 104 does not move relative to the base.

FIG. 5 also shows that the rail 502 can include a cap 510. The cap 510 is placed over the snap 508. The cap 510 prevents debris or dirt from entering the groove. This is critical because debris and dirt can both damage the rail 502 and prevent the rail 502 from fully entering the groove. I.e., debris and dirt can render the groove and base essentially useless. Likewise, the cap 510 forms an area that the user can grasp in order to release the snap 508. I.e., the user can place his/her finger under the cap 510 to release the snap 508 from the groove.

FIG. 5 further shows that the upper can include a webbing 512. The webbing 512 serves as a transition between the rest of the upper and the rail 502. That is the webbing 504 is attached to both the rail 502 and the rest of the upper. The webbing allows for flexibility so that the rail 502 can be inserted without the upper exactly lined up with the groove. The webbing 512 can include any suitable material, such as nylon or polyester. The webbing 512 is thinner than the rail 502, which makes it easier for the user to insert the rail 502 into the groove.

FIG. 5 additionally shows that the upper 104 can include an anti-tear feature 514. The rail 502 is built in one tool with the webbing 512 and cut to size based on the need and production order (for example, all rails 502 can be manufactured for a size 11 shoe then cut down to work with the desired shoe size during production to reduce investment and inventory cost). Thus, the webbing 512 can fray at the cut location. The anti-tear feature 514 prevents fraying and strengthens the webbing 512 along the cut edge. Further, the anti-tear feature 514 assures that the webbing 512 doesn't break down after repeated uses when the user is pulling out and re-inserting the rail 502.

Figure 6A:
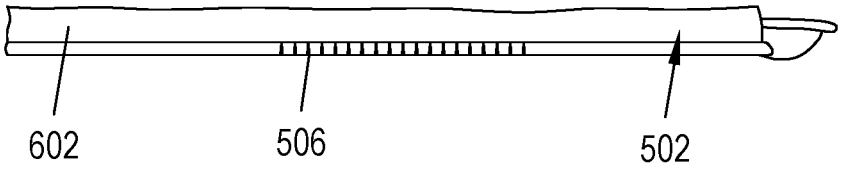
FIG. 6A illustrates a front view of an example of a rail.
Figure 6B:
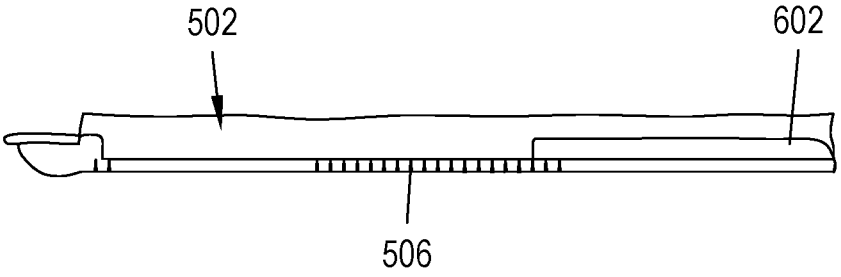
FIG. 6B illustrates a rear view of an example of a rail.

FIGS. 6A and 6B (collectively "FIG. 6") illustrates an example of a rail 502. FIG. 6A illustrates a front view of the example of a rail 502; and FIG. 6B illustrates a rear view of the example of a rail 502. The rail 502 can be cut to size and attached to an upper during the manufacturing process. That is, a single rail can be used to regard different uppers, by cutting the rail 502 to the proper size and then attaching to the upper. This allows for ease of manufacture of the rail 502 and makes manufacture of the upper easier, as different sizes of rail 502 are not needed.

FIG. 6 shows that the rail can includes a solid polyurethane ("PU") section 602 which extends beyond the flex cuts 506. The solid PU section 602 allows for each rail 502 to be cut after attachment to the upper. I.e., each rail 502 can be made the same length during manufacture and then cut to the appropriate size during the process of attaching to the upper. I.e., the solid PU section 602 makes manufacture of the upper standardized, regardless of shoe size. The solid PU section 602 is approximately 2 cm tall.

Figure 7A:
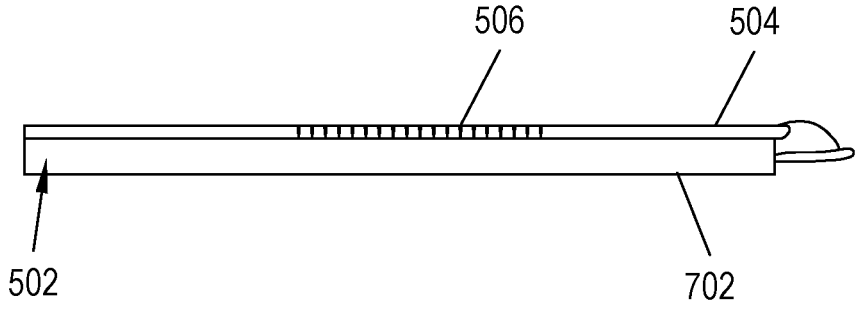
FIG. 7A illustrates a front view of an example of a solid PU rail.
Figure 7B:
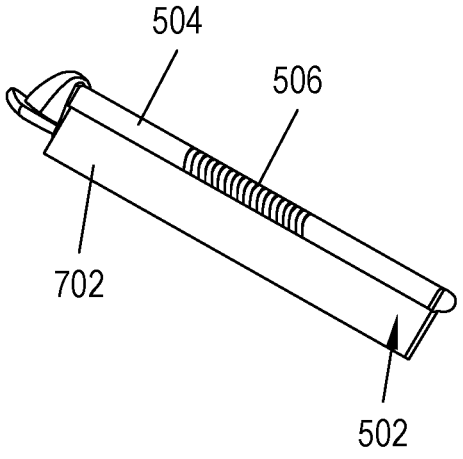
FIG. 7B illustrates a perspective view of an example of a solid PU rail.

FIGS. 7A and 7B (collectively "FIG. 7") illustrates an example of a solid PU rail 502. FIG. 7A illustrates a front view of the example of the solid PU rail 502; and FIG. 7B illustrates a rear view of the example of the solid PU rail 502. A solid PU rail 502 allows for direct attachment to an upper. E.g., if the upper is made of leather, then the upper can be sewn onto the rail 502.

FIG. 7 further shows that the rail 502 can include a body 702. The body 702 allows for attachment to the upper. In particular, the upper and the body 702 are attached (e.g., sewn) to one another to ensure that they don't separate from one another during regular use. I.e., a user will be pulling on the upper (either directly or by pulling on the upper) when the bar 504 is within the groove and experiencing friction. Thus, a strong enough attachment is critical to ensure that during use the upper and the body 702 remain attached to one another.

FIG. 7 additionally shows that the rail 502 can is extended beyond the flex cuts 506. This allows for each rail 502 to be cut after attachment to the upper. I.e., each rail 502 can be made the same length during manufacture and then cut to the appropriate size during the process of attaching to the upper. I.e., the extended portion of the rail makes manufacture of the upper easier.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An interchangeable shoe, the interchangeable shoe comprising:
- a base, wherein the base includes a footbed;
- an upper; and
- an attachment, wherein the attachment releasably attaches the upper to the base, the attachment including:
  - a groove in the footbed, wherein the groove includes a detent; and
  - a rail attached to the upper, wherein the rail:
    - is configured to be inserted into or removed from the groove; and
    - includes a snap, wherein the snap is configured to mate with the detent in the groove.

2. The interchangeable shoe of claim 1, wherein the rail includes one or more flex cuts.

3. The interchangeable shoe of claim 1, wherein the base includes a flat.

4. The interchangeable shoe of claim 1, wherein the base includes a heel.

5. The interchangeable shoe of claim 1, wherein the upper is configured to completely cover the foot of the user.

6. The interchangeable shoe of claim 1, wherein the upper is configured to cover only a portion of the user's foot.

7. The interchangeable shoe of claim 1, wherein the groove is:
- parallel in straight sections; and
- non-parallel in non-straight sections.

8. The interchangeable shoe of claim 1, wherein the rail is "P" shaped.

9. The interchangeable shoe of claim 1, wherein the rail is "L" shaped.

10. The interchangeable shoe of claim 1, wherein the groove includes one or more chamfered edges.

11. An interchangeable shoe, the interchangeable shoe comprising:
- a base, wherein the base includes a footbed;
- an upper; and
- an attachment, wherein the attachment releasably attaches the upper to the base, the attachment including:
  - a groove in the footbed, wherein the groove includes:
    - chamfered edges; and
    - varying width in different sections of the groove;
    - a detent on one end of the groove;
  - a rail attached to the upper, wherein the rail:
    - is configured to be inserted into or removed from the groove; and
    - includes:
      - a body;
      - a bar on the body, wherein the bar is sized and shaped to match the size and shape of the groove;
      - one or more flex cuts in the bar, wherein the one or more flex cuts are configured to allow the bar to flex;
      - a snap, wherein the snap is configured to mate with the detent in the groove;
      - a cap over the snap, wherein the cap is configured to cover the detent and snap when mated;
      - a webbing, wherein the webbing attaches the body to the upper.

12. The interchangeable shoe of claim 11, wherein the groove includes a sloped end adjacent the detent.

13. The interchangeable shoe of claim 11, wherein the webbing is fused to the body of the rail.

14. The interchangeable shoe of claim 11, wherein the rail is injection molded onto the webbing.

15. An interchangeable shoe, the interchangeable shoe comprising:
- a base, wherein the base includes a footbed;
- an upper; and
- an attachment, wherein the attachment releasably attaches the upper to the base, the attachment including:
  - a groove in the footbed, wherein the groove includes:
    - chamfered edges; and
    - varying width in different sections of the groove;
    - a detent on one end of the groove;
    - a sloped area adjacent the detent, wherein the height of the groove changes in the sloped area; and
    - a curved on the end of the groove opposite the detent;
  - a rail attached to the upper, wherein the rail:
    - is configured to be inserted into or removed from the groove; and
    - includes:
      - a body;

a bar on the body, wherein the bar is sized and shaped to match the size and shape of the groove;

one or more flex cuts in the bar, wherein the one or more flex cuts are configured to allow the bar to flex;

a snap, wherein the snap is configured to mate with the detent in the groove;

a cap over the snap, wherein the cap is configured to cover the detent and snap when mated; and a webbing, wherein the webbing attaches the body to the upper.

16. The interchangeable shoe of claim 15, further comprising:

an anti-tear feature.

17. The interchangeable shoe of claim 15, wherein the webbing includes:

nylon.

18. The interchangeable shoe of claim 15, wherein the webbing includes:

polyester.

* * * * *